United States Patent [19]

Kusters

[11] Patent Number: 4,563,856

[45] Date of Patent: Jan. 14, 1986

[54] BAG CLOSING APPARATUS USING CLOSURE TAGS

[75] Inventor: Willy Kusters, Bruggen, Fed. Rep. of Germany

[73] Assignee: Clements Industries, Inc., South Hackensack, N.J.

[21] Appl. No.: 525,535

[22] Filed: Aug. 23, 1983

[30] Foreign Application Priority Data

Aug. 26, 1982 [DE] Fed. Rep. of Germany ..... 8224132

[51] Int. Cl.[4] ..... B65B 61/06

[52] U.S. Cl. ..... 53/138 A; 53/390; 53/417

[58] Field of Search ..... 53/138 A, 138 R, 390, 53/417, 583

[56] References Cited

U.S. PATENT DOCUMENTS

| | | | |
|---|---|---|---|
| 3,163,969 | 1/1965 | Irwin et al. | 53/138 A |
| 3,163,970 | 1/1965 | Paxton | 53/138 A |
| 3,579,955 | 5/1971 | Gunyou et al. | 53/138 A |
| 3,621,632 | 11/1971 | Browning | 53/138 A |
| 3,668,818 | 6/1972 | Holmes | 53/138 A |
| 3,983,681 | 10/1976 | Britt et al. | 53/138 A |

*Primary Examiner*—John Sipos
*Assistant Examiner*—Donald R. Studebaker
*Attorney, Agent, or Firm*—Blum, Kaplan, Friedman, Silberman & Beran

[57] ABSTRACT

The bag closing apparatus includes a horizontal plate for supporting a coiled strip of bag closure tags, a channel having a width corresponding to the thickness of the bag closure tags and a height greater than the height of the bag closure tags. The channel terminates with an inclined surface such that the upper surface of the tag can be exposed with the entrance to the opening within the tag lying substantially flush with the inclined surface. When a bag to be closed is slid manually downward along the inclined surface, the crushed end of the bag enters the opening in the closure tag and is seated therein. The bag and the closure tag are then manually slid until the closure tag leaves the channel and is broken from the strip. In the process of clearing the first closure tag, engaged with a bag, from the channel, the next following closure tag is brought into position to receive the next bag to be closed.

14 Claims, 4 Drawing Figures

BAG CLOSING APPARATUS USING CLOSURE TAGS

BACKGROUND OF THE INVENTION

This invention relates generally to a bag closing apparatus of the type which applies closure tags around the compressed inlet end of the bag. Bag closure tags of plastic are usually detatched, like stamps, tickets, or the like from a roll suspended for rotation about a horizontal axis, by tearing the tags from the roll. This is clumsy and inconvenient and requires separate actions of separating a tag from the roll of tags and then applying the tag to the end of the bag.

What is needed is a bag closing apparatus using closure tags which minimizes the amount of separate handling of bags and closures required to effect application of the closure tag to the bag.

SUMMARY OF THE INVENTION

Generally speaking, in accordance with the invention, a bag closing apparatus especially suitable for applying closure tags in a semi-automatic process is provided. The bag closing apparatus makes it possible for the end of the bag which is to be closed, to be inserted rapidly and accurately into the opening in the bag closure tag, and then enables the tag to be torn or broken off from a strip of bag closure tags. In the process of inserting a bag in a closure tag, the next tag is automatically fed into place for receipt of the next bag. The bag closing apparatus includes a horizontal plate for supporting a coiled strip of bag closure tags, a channel having a width corresponding to the thickness of the bag closure tags and a height greater than the height of the bag closure tags. The passage channel may be straight, curved, winding or twisted for example, the tags may pass out of the channel opening after being turned 90 degrees relative to the input strip of bag closure tags.

The channel terminates with an inclined surface such that the upper surface of the tag is exposed, with the entrance to the opening within the tag lying substantially flush with the inclined surface. When a bag to be closed is slid manually downward along the inclined surface, the crushed end of the bag enters the opening in the closure tag and is seated therein. The bag and the closure tag are then manually slid until the closure tag leaves the channel and is broken from the strip. In the process of clearing the first closure tag, with bag, from the channel, the next following closure tag is brought into position to receive the next bag to be closed.

Accordingly, it is an object of this invention to provide an improved bag closing apparatus using closure tags, which feeds additional closure tags in a semi-automatic operation.

Another object of this invention is to provide an improved bag closing apparatus using closure tags which requires no handling of the closure tag until the bag to be closed is already engaged with the tag.

A further object of this invention is to provide an improved bag closing apparatus using closure tags which is simple to operate and convenient to store when not in use.

Still other objects and advantages of the invention will in part be obvious and will in part be apparent from the specification.

The invention accordingly comprises the features of construction, combination of elements, and arrangements of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
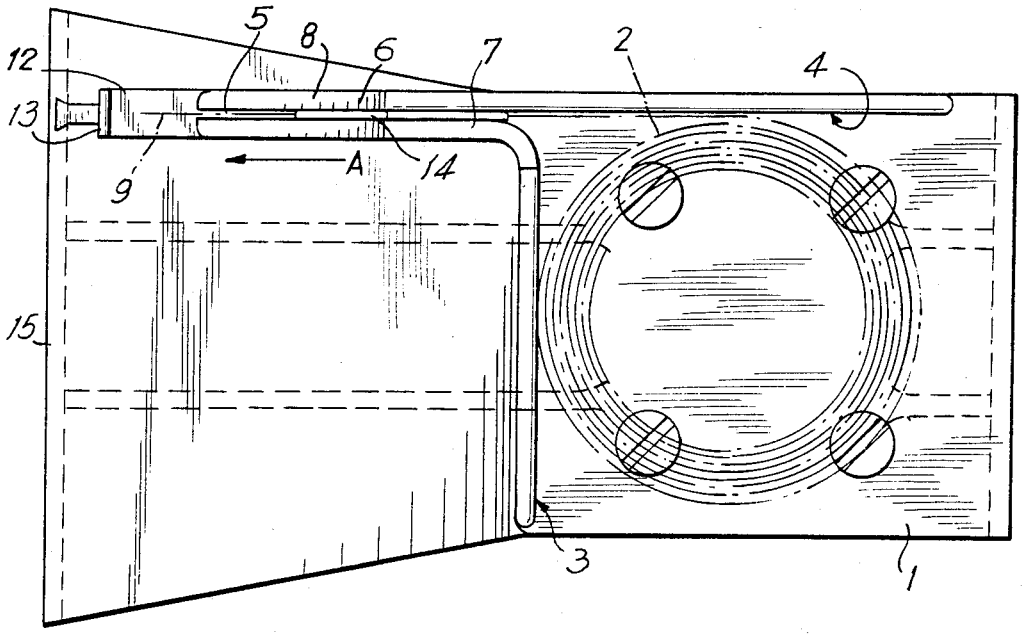
FIG. 1 is a plan view of a bag closing apparatus using closure tags in accordance with the invention.
Figure 2:
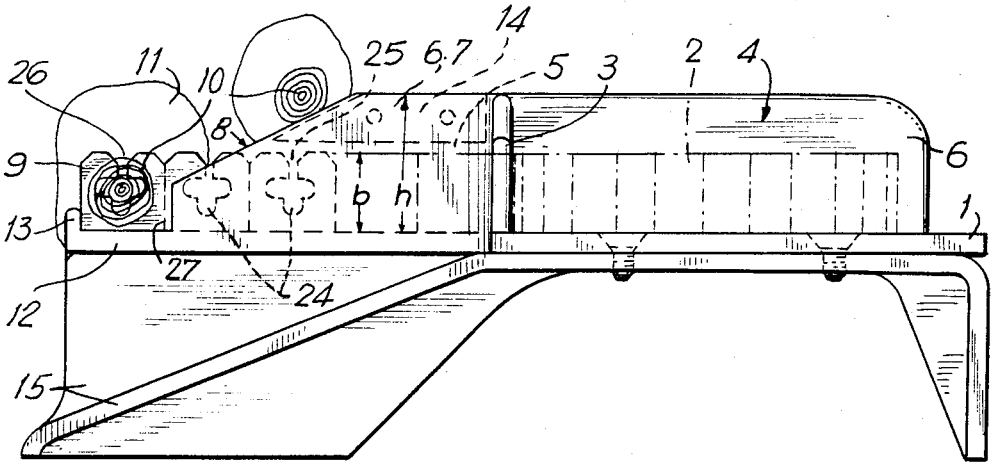
FIG. 2 is a side elevational view of the bag closing apparatus using closure tags of FIG. 1.

With reference to FIGS. 1 and 2, the bag closing apparatus using closure tags in accordance with the invention comprises a support plate 1 on which a coiled strip 2 of bag closure tags 9 rests.

A stop plate 4 stands vertically on the support plate 1 and extends laterally, including a portion 6 serving as a side wall and having an inclined surface 8.

A second stop plate 3 stands vertically on the support plate 3 and is formed as a right angle having a portion serving as a side wall 7 having a segment with an inclined surface 8. The side walls 6, 7 are parallel to each other and spaced apart leaving a passage channel 5 therebetween, the width of the channel 5 being slightly greater than the thickness of the bag closure tags 9. The coiled strip 2 lies on the surface plate 1 constrained and guided by surfaces of the stop plates 3,4 which are at right angles one to the other. A rail 12 is flush with the upper surface of the support plate 1 and forms a base for the passage channel whereon the closure tags 9 slide. The rail 12 extends beyond the discharge end of the passage channel 5.

The closure tags 9 are formed of plastic and connected together in the coiled strip 2 like stamps, tickets or the like, with a relatively weak connection between them to facilitate separation without damage to the individual tags. Conventionally the closure tags 9 include a central opening 24 which receives and retains the end 10 of the bag 11 which is to be closed. The bag 11 enters the central opening 24 through a narrow slit 25 which expands into a triangular notch 26 at the surface of the closure tag 9 where the bag 11 enters. The triangular notch 26 at the surface facilitates entry of the bag 11 into the central opening 24 by way of the narrow slit 25, all in the known manner. The coil strip 2 rests on the support plate 1 with the notched openings 26 of the closure tags 9 facing upward (FIG. 2). As best seen in FIG. 1, the joined closure tags 9 feed from the coiled strip 2 into the passage channel 5 such that the strip moves substantially tangentially from the coil, against the stop plate 4, into the passage channel 5.

The height h of the channel 5 is greater than the height b of the strip 2 of bag closure tags 9. The inclined plane at one end has a height h and at the other end has a height less than the tag height b, such that there is a position of the closure tags 9 where the entrance to the slit 25 to the central opeing 24 is substantially flush with the inclined surfaces 8 on both sides of the passage channel 5 (FIG. 2).

A stop 13 extends vertically upward at the end of a rail 12 and transversely to the direction of motion A of the strip of closure tags 9 through the channel passage 5. When the strip of closure tags 9 is extended from the coil 2 through the channel 5 until contact is made with the stop 13, the leading closure tag which abuts the stop 13 is fully exposed, that is, is not constrained in any way in the passage channel 5. The next following tag closure 9, still attached to the leading closure tag 9, is positioned substantially between the inclined surfaces 8 within the passage channel 5, having the entrance to the slit 25 to the interior tag opening 24 substantially flush with the inclined surface 8. Length of the channel 5 is determined such that the leading edge 27 of the next-following tag 9 extends just externally of the channel passage 5 and the inclined surface 8.

A spacer 14 is detachably inserted into the channel 5, closing the top thereof and limiting vertical motion of the strip of closure tags 9 within the passage channel 5. Spacers of different heights can be used to accomodate closure tags of different heights b. The support plate 1 is mounted on a pedestal 15 which extends beyond the stop 13 and the termination of the inclined surface 8 so as to prevent tipping of the apparatus when the leading bag closure 9 is torn or broken from the strip 2 of bag closure tags as described hereinafter. It should be understood that the spacer 14 and pedestal 15 may be omitted in alternative embodiments of a bag closure apparatus using closure tags in accordance with the invention.

Operation is now described. When the coiled strip 2 is placed on the support plate 1, the free end of the coiled strip is threaded into the passage channel 5 until the first bag closure tag on the strip is sufficiently advanced in the passage channel 5 to enable the end 10 of the bag 11, which is to be closed, to be moved slidingly downward along the inclined surface 8 and inserted into the notch 26, slit 25 and opening 24 in the tag 9. Preferably, the coiled strip is threaded into the passage channel 5 such that the opening to the slit 25 in the tag 9 is flush with the inclined surface 8. In the process of inserting the end 10 of the bag 11 into the tag opening 24, the leading bag closure tag 9 slides on the support plate 1 until coming to rest against the stop 13. At that position, the leading closure tag 9 is torn, or broken by bending from the strip as a result of the weakened connection, for example, perforations, which separate the closure tags 9 on the strip. The inclined surfaces 8 are so positioned relative to the stop 13 at the end of the support plate 1 that the inclined surfaces 8 provide a substantially flush lead into the opening on the top edge of the first following bag closure tag when the leading bag closure tag 9 comes into contact with the stop 13.

After the first bag closure tag has been torn or broken from the strip of bag closure tags, the bag closure tag which is then in the leading position lies in the same position where the end of the next bag which is to be closed, can in sliding along the inclined surfaces enter the slit opening of the leading bag closure tag. Thus, a continuous repetitive operation may be performed with closure tags 9 being fed each time by the process by which a bag is closed and the lead tag is broken off.

Figure 3:
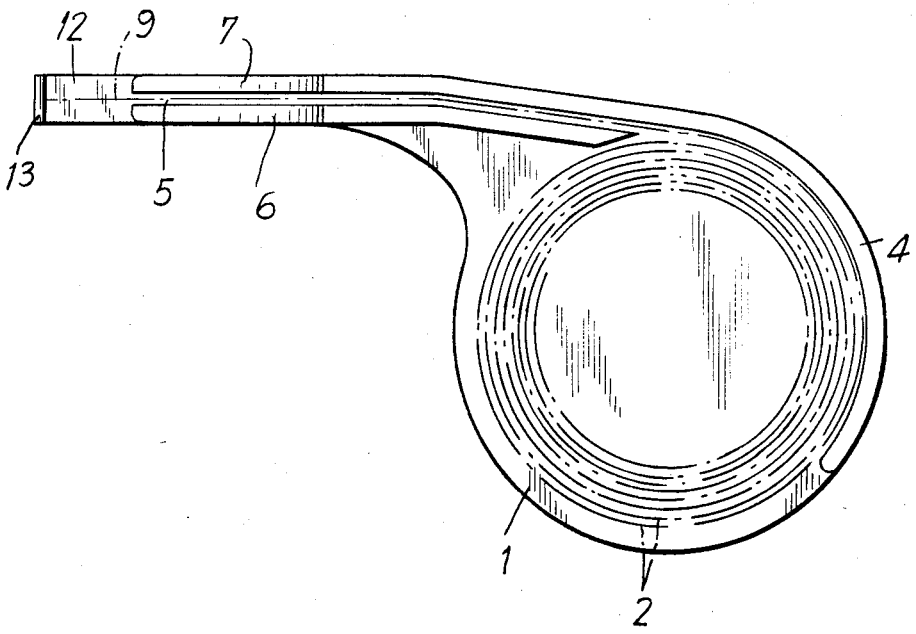
FIG. 3 is a view similar to FIG. 1 of an alternative embodiment of a bag closing apparatus using closure tags in accordance with the invention.

FIG. 3 illustrates an alternative embodiment of a bag closing apparatus using closure tags, in accordance with the invention. Similar parts in the different figures are given the same reference numerals. In FIG. 3, the support plate is circular and the passage channel 5 is not straight but may be slightly curved or made up of intersecting straight portions. A single vertical stop surface 4, standing on the support plate 1, is curved to the contours of the coiled strip 2 and provides satisfactory performance in guiding and constraining the strip 2 as it is fed into the channel 5.

Figure 4:
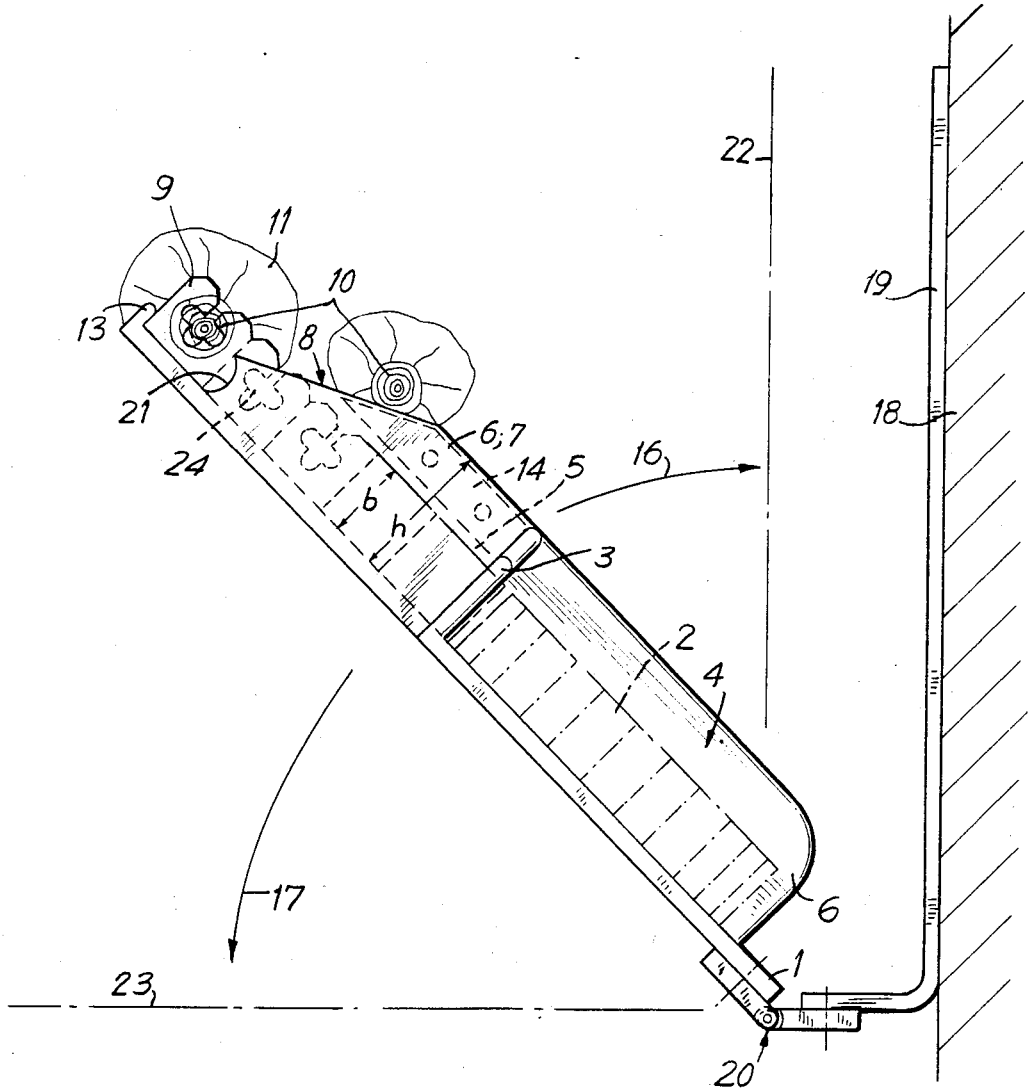
FIG. 4 is a side view of another alternative embodiment of a bag closing apparatus using closure tags in accordance with the invention.

FIG. 4 illustrates a bag closing apparatus using closure tags in accordance with the invention having a construction substantially similar to that shown in FIGS. 1 and 2. However, the embodiment of FIG. 4 is pivotably mounted for swinging upward in the direction of the arrow 16 and downward in the direction of the arrow 17 about the pivot axis of a hinge 20. The apparatus can be maintained in the vertical position indicated by the broken line 22 or in the horizontal position indicated by the broken line 23. The hinge 20 is attached by one leaf to a bracket 19 which is fastened on a wall 18 and the other leaf of the hinge 20 connects to the support plate 1. The apparatus is operative when in the horizontal position 23 and can be conveniently stored when not in use against the wall 18 in a position indicated at 22.

An undercut 21 at the end of the inclined surfaces 8 facilitates insertion of the bag neck 10 fully into the central opening 24 of the closure tag 9. This undercut 21 is formed at the tapered end of the walls 6, 7 of the passage channel 5 and is equally applicable in the construction illustrated in FIGS. 1, 2.

It will thus be seen that the objects set forth above, and those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A bag closing apparatus for applying a closure to a collapsed end of a bag, said closure including engagement means for retaining said collapsed end of said bag, comprising:

a channel of extended length having an outlet end, a horizontal base surface extending beyond said outlet end, and side walls extending substantially vertically from said base surface, the distance between said side walls corresponding to the dimensions of said closure allowing for sliding motion on said base of said closure within said channel, a first portion of said channel having said side walls extending away from said base by a distance greater than the extension of said closure from said base, a second portion of said channel having said side walls extending from said base to form inclined surfaces leading to said outlet end, said side walls and said outlet end extending from said base by a distance less than the extension of said closure from said base, a closure sliding through said first portion toward said outlet end having said engagement means between said side walls such that engagement with said bag is prevented, said engagement means at least in part being exposed beyond said side walls during movement of said closure through said second tapered portion and opening upward to receive said bag end such that engagement with said bag is enabled while said closure is in said channel, and means for terminating the sliding of said closure along said base surface, said means for terminating acting after said closure has entirely cleared said outlet end of said channel.

2. A bag closing apparatus as claimed in claim 1, wherein a plurality of said closures slide in a contiguous relationship one to the other through said channel towards said outlet end, only one closure of said plurality of closures having said engagement means exposed at any time in said second channel portion.

3. A bag closing apparatus as claimed in claim 2, wherein said means for terminating the sliding is positioned away from said outlet end by a distance such that one said contiguous closure outside said channel engages said termination means while concurrently the following contiguous closure in said channel has engagement means exposed in said second portion of said channel.

4. A bag closing apparatus as claimed in claim 3, and further comprising a spacer member spaced from said base and closing at least a portion of said channel and limiting motion of said closures away from said base.

5. A bag closing apparatus as claimed in claim 3, wherein said closures are flat tags detatchably connected in a strip within said channel.

6. A bag closing apparatus as claimed in claim 5, wherein said engagement means includes a central opening for retaining said collapsed end and a restricted opening between an outer surface of said tag and said central opening for entrance of said collapsed end to said central opening.

7. A bag closing apparatus as claimed in claim 6, wherein entrance to said restricted opening is exposed at said inclined surface of a first following tag when the leading tag outside said channel engages said termination means.

8. A bag closing apparatus as claimed in claim 1, wherein said means for terminating the sliding along said base is a stop rising vertically at the end of said base surface.

9. A bag closing apparatus as claimed in claim 7, wherein said means for terminating the sliding along said base is a stop rising vertically at the end of said base surface.

10. A bag closing apparatus as claimed in claim 7, and further comprising a support plate for supporting thereon a supply of said connected closure tags, one end of said supply of tags being threaded into said channel at the end thereof opposite to said outlet end.

11. A bag closing apparatus as claimed in claim 10, wherein said supply of tags is in the form of a coiled strip of tags, said support plate including means for constraining said coil, said strip moving tangentially from said coil into said channel.

12. A bag closing apparatus as claimed in claim 10 and further comprising a pedestal said support plate, said pedestal extending towards said stop at least beyond said outlet end of said channel.

13. A bag closing apparatus as claimed in claim 10, and further comprising a hinge having two leaves attached on one leaf to said support plate, the other leaf of said hinge being adapted for attachment to a wall, said apparatus being storable with said support plate parallel to said wall and operable with said support plate tilted to expose said inclined surface.

14. A bag closing apparatus as claimed in claim 1, wherein the ends of said side surfaces at said outlet end of said channel are undercut beneath said inclined surface.

* * * * *